US008276671B2

(12) United States Patent
Neto et al.

(10) Patent No.: US 8,276,671 B2
(45) Date of Patent: Oct. 2, 2012

(54) BRIDGING HANGER AND SEAL RUNNING TOOL

(75) Inventors: Guilherme Pedro Eppinghaus Neto, Macae (BR); Fernando Sousa, Rio das Ostras (BR)

(73) Assignee: Vetco Gray Inc., Houston, TX (US)

( * ) Notice: Subject to any disclaimer, the term of this patent is extended or adjusted under 35 U.S.C. 154(b) by 125 days.

(21) Appl. No.: 12/752,340

(22) Filed: Apr. 1, 2010

(65) Prior Publication Data

US 2011/0240306 A1 Oct. 6, 2011

(51) Int. Cl.
*E21B 23/00* (2006.01)

(52) U.S. Cl. ..... 166/348; 166/339; 166/368; 166/387

(58) Field of Classification Search ..... 166/344, 166/336–339, 341, 345, 348, 351, 352, 368, 166/381–383, 85.1, 85.3, 181
See application file for complete search history.

(56) References Cited

U.S. PATENT DOCUMENTS 3,871,449 A * 3/1975 Ahlstone ..... 166/183
3,897,823 A * 8/1975 Ahlstone ..... 166/120
3,913,670 A * 10/1975 Ahlstone ..... 166/182
3,924,678 A * 12/1975 Ahlstone ..... 166/120
3,924,679 A * 12/1975 Jansen, Jr. ..... 166/182
4,634,152 A * 1/1987 Pettit ..... 285/39
4,811,784 A * 3/1989 Theiss ..... 166/208
4,823,871 A * 4/1989 McEver et al. ..... 166/182
4,836,288 A * 6/1989 Wester ..... 166/348
4,969,516 A * 11/1990 Henderson et al. ..... 166/182
5,069,287 A * 12/1991 Short et al. ..... 166/339
5,069,288 A * 12/1991 Singeetham ..... 166/348
5,088,556 A * 2/1992 Short et al. ..... 166/339
5,105,888 A * 4/1992 Pollock et al. ..... 166/348
5,107,931 A * 4/1992 Valka et al. ..... 166/342
5,249,629 A * 10/1993 Jennings ..... 166/348
5,273,117 A * 12/1993 Reimert ..... 166/348
5,307,879 A * 5/1994 Kent ..... 166/382
5,372,201 A * 12/1994 Milberger ..... 166/382
5,542,475 A * 8/1996 Turner et al. ..... 166/387
5,735,344 A * 4/1998 Duncan ..... 166/75.14
5,791,418 A * 8/1998 Milberger et al. ..... 166/368
6,386,291 B1 * 5/2002 Short et al. ..... 166/368
6,401,827 B1 * 6/2002 Ferguson et al. ..... 166/382
6,516,876 B1 * 2/2003 Jennings ..... 166/77.51
6,668,919 B2 * 12/2003 Radi ..... 166/208
6,823,938 B1 * 11/2004 Milberger ..... 166/209

(Continued)

OTHER PUBLICATIONS

U.S. Appl. No. 12/416,780, filed Apr. 1, 2009.

(Continued)

*Primary Examiner* — Matthew Buck
(74) *Attorney, Agent, or Firm* — Bracewell & Giuliani LLP

(57) ABSTRACT

A running tool sets and pressure tests a bridging hanger and a packoff in a single trip. The running tool has a stem, an inner body, and a piston. The inner body is connected to the stem so that rotation of the stem relative to the inner body will cause the stem to move longitudinally. The piston is connected to the stem so that the stem and piston rotate and move longitudinally in unison. A piston engagement element is housed in the inner body and is adapted to engage the piston when the bridging hanger is set to prevent premature setting of the packoff. The piston engagement element can be disengaged once the bridging hanger is set, thereby allowing the piston to set the packoff.

8 Claims, 7 Drawing Sheets

U.S. PATENT DOCUMENTS

| | | | | |
|---|---|---|---|---|
| 6,918,446 | B2 * | 7/2005 | Borak, Jr. | 166/382 |
| 7,028,777 | B2 * | 4/2006 | Wade et al. | 166/343 |
| 7,073,591 | B2 * | 7/2006 | Massie et al. | 166/348 |
| 7,096,956 | B2 * | 8/2006 | Reimert | 166/348 |
| 7,231,970 | B2 * | 6/2007 | Matusek et al. | 166/115 |
| 7,240,735 | B2 * | 7/2007 | Crozier | 166/344 |
| 7,647,973 | B2 * | 1/2010 | Minassian et al. | 166/338 |
| 7,861,789 | B2 * | 1/2011 | Nelson | 166/348 |
| 7,909,107 | B2 * | 3/2011 | Gette | 166/382 |
| 2006/0191680 | A1 * | 8/2006 | Nelson | 166/208 |

OTHER PUBLICATIONS

U.S. Appl. No. 12/490,874, filed Jun. 24, 2009.

* cited by examiner

BRIDGING HANGER AND SEAL RUNNING TOOL

FIELD OF THE INVENTION

This technique relates in general to tools for running well pipe hangers in subsea wells, and in particular to a running tool that can set and test a bridging hanger and a packoff seal in one trip.

BACKGROUND OF THE INVENTION

A subsea well of the type concerned herein will have a wellhead supported on the subsea floor. Casing hanger running tools perform many functions such as running and landing casing strings, cementing strings into place, and installing and testing packoffs. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. Afterward, a packoff is positioned between the wellhead bore and an upper portion of the casing hanger. This seals the casing hanger annulus.

Once a packoff is set, it is often tested by applying fluid pressure to an upper side of the packoff. If the packoff has not been properly set, fluid pressure may leak past the annulus packoff, causing the casing to collapse. On rare occasions, the packoff may be unable to pass the pressure test, possibly due to damage on the interior wall of the wellhead housing. If so, one remedy is to install an emergency or bridging hanger in the wellhead housing. The bridging hanger does not support a string of casing, but has an interior profile that is normally the same as the profile in the casing hanger. The operator lands and seals the lower portion of the bridging hanger to the casing hanger. The operator installs a packoff between the upper exterior portion of the bridging hanger and the wellhead housing above the casing hanger. The operator then runs the tubing and lands and seals the tubing hanger in the bridging hanger.

In the prior art, a running tool would land and seal the bridging hanger to the casing hanger in one trip, and then install a packoff between the bridging hanger and the wellhead housing in another trip. A need exists for a technique that allows the running tool to land and seal the bridging hanger to the casing hanger and install a packoff in the same trip. The following technique may solve one or more of these problems.

SUMMARY OF THE INVENTION

In an embodiment of the present technique, a running tool sets and tests a bridging hanger and allows a bridging hanger packoff to be set and tested in the same trip. The running tool is comprised of an inner body, a piston, a cam, and a stem. The inner body houses a piston engagement element and a hanger engagement element. The piston engagement element is adapted to engage the piston to prevent premature setting of the bridging hanger packoff. The hanger engagement element is adapted to engage the bridging hanger, thereby locking the running tool to the bridging hanger. The inner body substantially surrounds and is connected to the stem of the running tool. A cam is connected to and is positioned between a portion of the inner body and the stem. When the running tool is positioned within the bridging hanger, rotation of the stem will cause the cam to move longitudinally relative to the inner body. The longitudinal movement of the cam extends the piston and hanger engagement elements radially outward. When the hanger engagement element is engaged with the bridging hanger, rotation of the stem will cause the stem to move longitudinally relative to the inner body. The piston substantially surrounds the inner body and the piston is connected to the stem so that the piston and the stem rotate and move longitudinally in unison.

When the bridging hanger is to be set and tested, the piston engagement element engages the piston, preventing the piston from moving longitudinally relative to the inner body, and thus, the bridging hanger packoff from setting prematurely. Once the bridging hanger has been set and tested, the stem is rotated further, causing the cam to move further longitudinally relative to the inner body, thereby retracting the piston engagement element. The piston may now move longitudinally relative to the inner body to set and test the bridging hanger packoff.

DETAILED DESCRIPTION OF THE INVENTION

Figure 1:
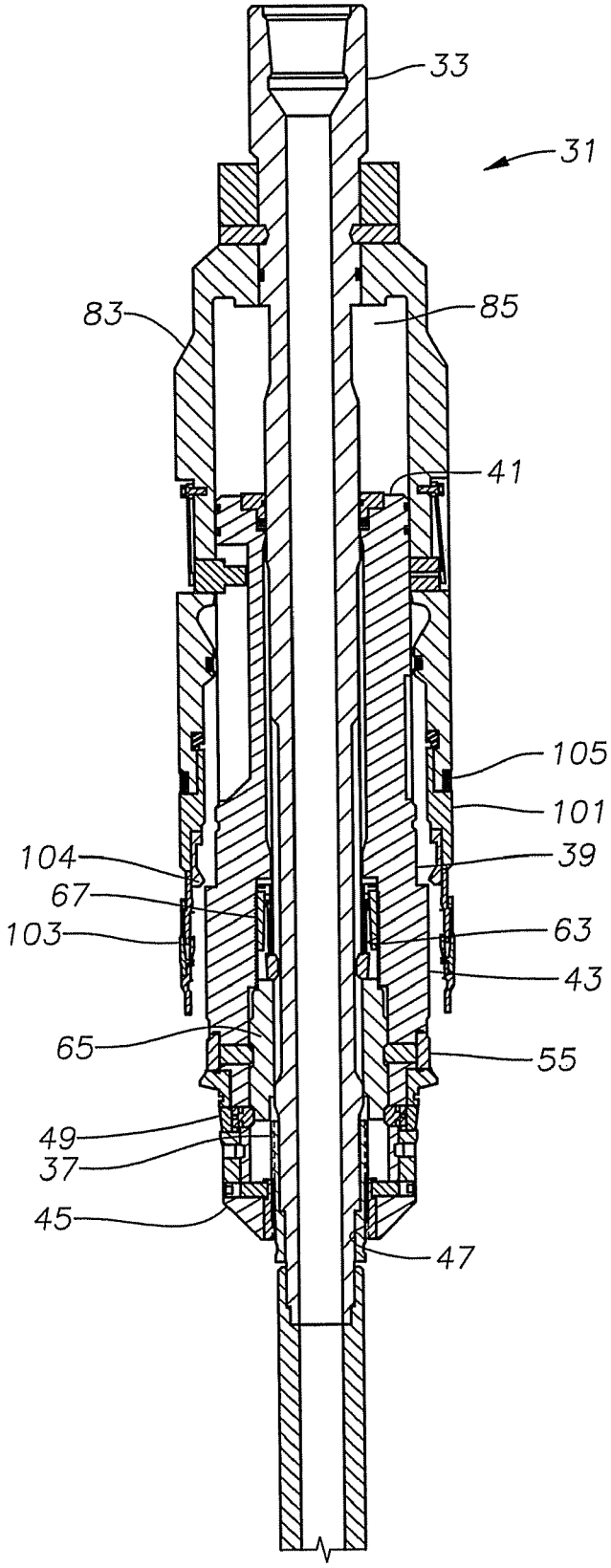
FIG. 1 is a sectional view of a running tool constructed in accordance with the present technique with the piston cocked and the hanger and piston engagement elements retracted.

Referring to FIG. 1, there is generally shown an embodiment for a running tool 31 that is used to set and test a bridging hanger 53 (FIG. 2) and a bridging hanger packoff 103. The running tool 31 is comprised of a stem 33. The stem 33 is a tubular member with an axial passage 35 extending therethrough. The stem 33 connects on its upper end to a string of drill pipe (not shown). A lower portion of the stem 33 has threads 37 in its outer surface.

The running tool 31 has an inner body 39 that surrounds the stem 33, as the stem 33 extends axially through the inner body 39. The inner body 39 has an upper body portion 41 and a lower body portion 43.

Figure 2:
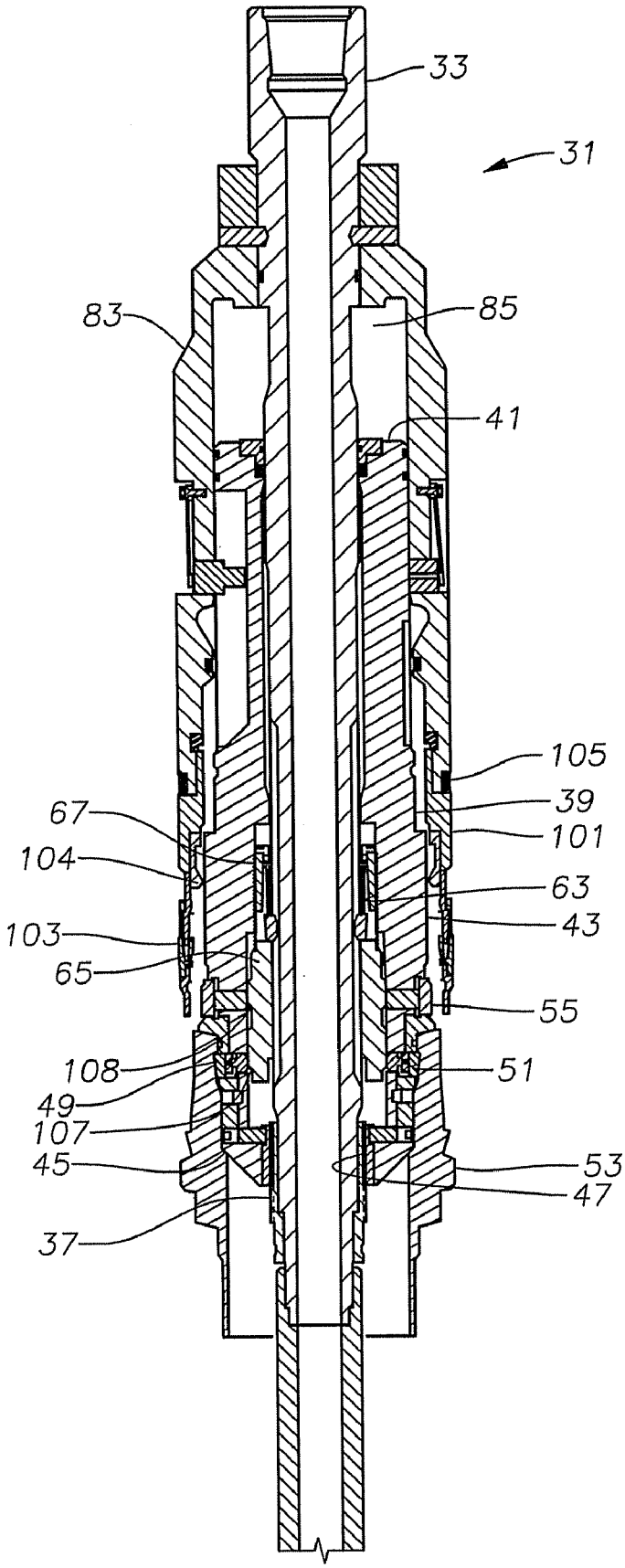
FIG. 2 is a sectional view of the running tool of FIG. 1 in the running position with the hanger engagement element engaged and the piston engagement element extended.

The lower body portion 43 of the inner body 39 is connected to a bearing cap 45. The bearing cap 45 has threads 47 along its inner surface that are engaged with the threads 37 on the outer surface of the stem 33. The lower portion 43 of the inner body 39 and the bearing cap 45 houses a hanger engagement element 49. In this particular embodiment, the hanger engagement element 49 is a set of dogs having a smooth inner surface and a contoured outer surface. The contoured outer surface is adapted to engage a complimentary contoured surface 51 on the inner surface of the bridging hanger 53 when the hanger engagement element 49 is engaged with the bridging hanger 53 (FIG. 2).

The lower body portion 43 of the inner body 39 also houses a piston engagement element 55, positioned a distance from the hanger engagement element 49. In this particular embodiment, the piston engagement element 55 is a ring having a smooth inner surface and a contoured outer surface.

The lower body portion 43 of the inner body 39 has an inner recess with threads 63 along its inner surface. A cam 65 is positioned between the stem 33 and the inner recess of the inner body 39. The cam 65 has threads 67 on its outer surface that are in engagement with the threads 63 on the surface of the inner recess of the lower body portion 43 of the inner body 39. The cam 65 and the stem 33 are connected to one another such that cam 65 and the stem 33 rotate in unison, but the cam 65 may move axially relative to the inner body 39, independent from the stem 33. For example, the cam 65 and the stem 33 may be connected to one another by means of anti-rotation keys.

An outer body or piston 83 surrounds the stem 33 and substantial portions of the inner body 39. The piston 83 is connected to the stem 33 such that the two rotate and move in unison. A piston chamber 85 is formed between an upper surface of the upper body portion 41 of the inner body 39, inner surface portions of the piston 83, and outer surface portions of the stem 33. The piston 83 is initially in an upper or cocked position relative to the inner body 39; meaning that the area of the piston chamber 85 is at its largest possible value, allowing for the piston 83 to be driven downward.

A setting sleeve 101 is connected to the lower end of the piston 83. The setting sleeve 101 carries a packoff seal 103 which is positioned along the lower end portion of the setting sleeve 101. The packoff seal 103 will act to seal the bridging hanger 53 to a high pressure housing 111 (FIG. 3) when properly set. A latch ring 104 is connected to the inner surface of the setting sleeve 101 and the packoff seal 103. The lower surface of the latch ring 104 is adapted to abuttingly contact the outer contoured surface of the piston engagement element 55 when it is engaged, preventing movement of the setting sleeve 101 downward relative to the inner body 39, and thus, premature setting of the packoff seal 103. While piston 83 is in the upper position, the packoff seal 103 is spaced above the bridging hanger 53.

Figure 3:
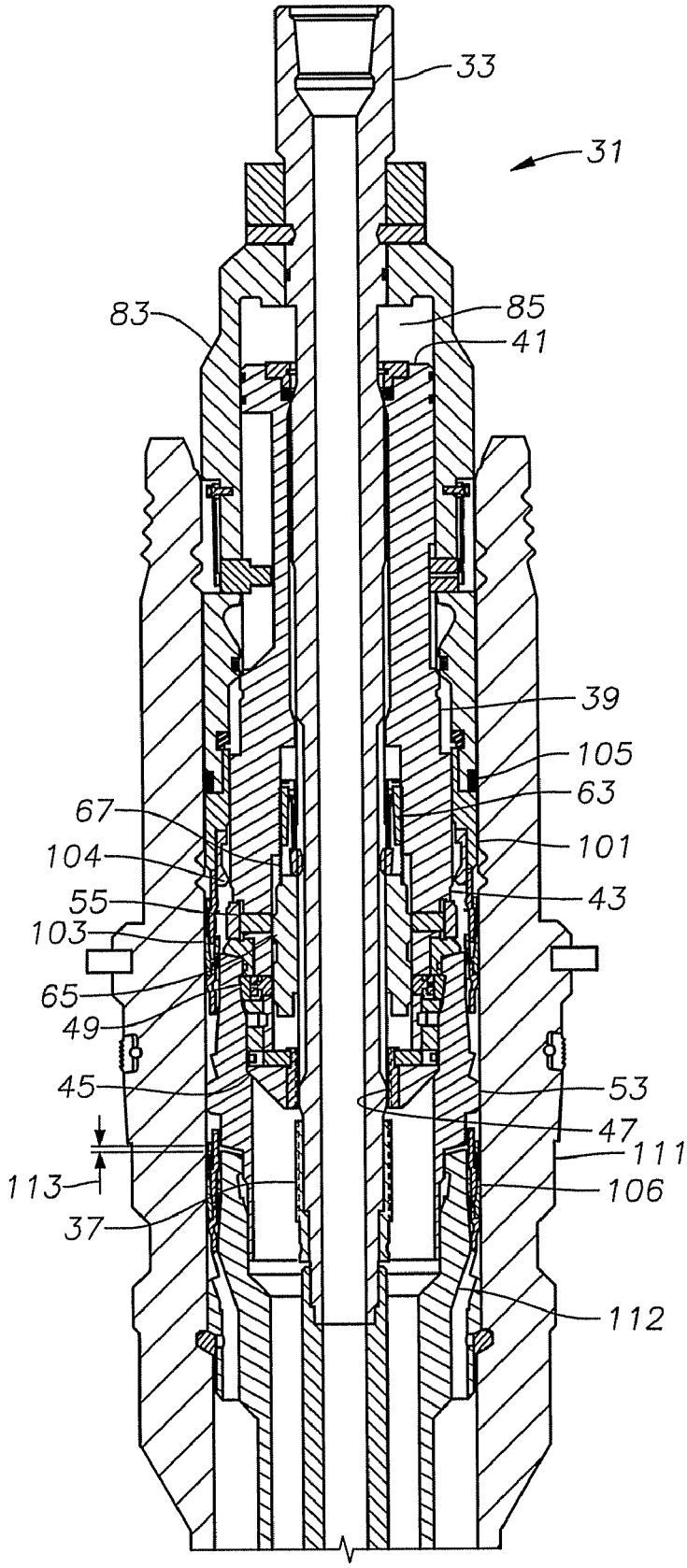
FIG. 3 is a sectional view of the running tool of FIG. 1 in the bridging hanger landing position with the piston and stem released from the inner body.

An elastomeric seal 105 is located on the outer surface of the running tool 31 between the piston 83 and the setting sleeve 101 and expands radially when weight is applied downward on it, thereby sealing between the running tool 31 and the high pressure housing 111 (FIG. 3).

Referring to FIG. 2, in operation, an originally run and installed packoff 106 (FIG. 3) is unable to pass the pressure test, possibly due to damage on the interior wall of the wellhead housing 111 (FIG. 3). In order to remedy this, an emergency or bridging hanger 53 is to be installed in the wellhead housing 111. In order to install the emergency or bridging hanger 53, the running tool 31 is initially positioned such that it extends axially through the bridging hanger 53. The piston 83 is in an upper or cocked position. The bridging hanger packoff seal 103 is carried by the setting sleeve 101 which is connected to the piston 83. The running tool 31 is lowered into the bridging hanger 53 until the outer surface of the inner body 49 and the bearing cap 45 of the running tool 31 slidingly engage the inner surface of the bridging hanger 53.

Once the running tool 31 and the bridging hanger 53 are in abutting contact with one another, the stem 33 is rotated four revolutions. As the stem 33 rotates, a portion of it unthreads from the bearing cap 45 and the stem 33 and the piston 83 move longitudinally downward relative to the inner body 39. As the stem 33 is rotated relative to the inner body 39, the cam 65 rotates in unison and simultaneously unthreads from the inner body 39 and moves longitudinally downward relative to the inner body 39. A first shoulder 107 on the outer surface of the cam 65 makes contact with the hanger engagement element 57, forcing it radially outward and in engaging contact with the profile 59 on the inner surface of the bridging hanger 53, thereby locking the inner body 39 to the bridging hanger 53. Simultaneously, a second shoulder 108 on the outer surface of the cam 65 makes contact with the piston engaging element 55, forcing it radially outward. Once the running tool 31 and the bridging hanger 53 are locked to one another, the running tool 31 and the bridging hanger 53 are lowered down the riser into the high pressure housing 111 until the bridging hanger 53 comes to rest within a previously run casing hanger 112 (FIG. 3).

Referring to FIG. 3, the stem 33 is then rotated four additional revolutions in the same direction. As the stem 33 is rotated relative to the inner body 39, the stem 33 completely unthreads from the bearing cap 45, freeing the stem 33 and the piston 83 to move further longitudinally downward relative to the inner body 39 and the bridging hanger 53. As the stem 33 and the piston 83 move further longitudinally downward relative to the inner body 39, the bridging hanger 53 lands within the casing hanger 112. However, as illustrated by a gap 113 between the bridging hanger 53 and the casing hanger 112, the bridging hanger 53 is not yet fully set and sealed.

Figure 4:
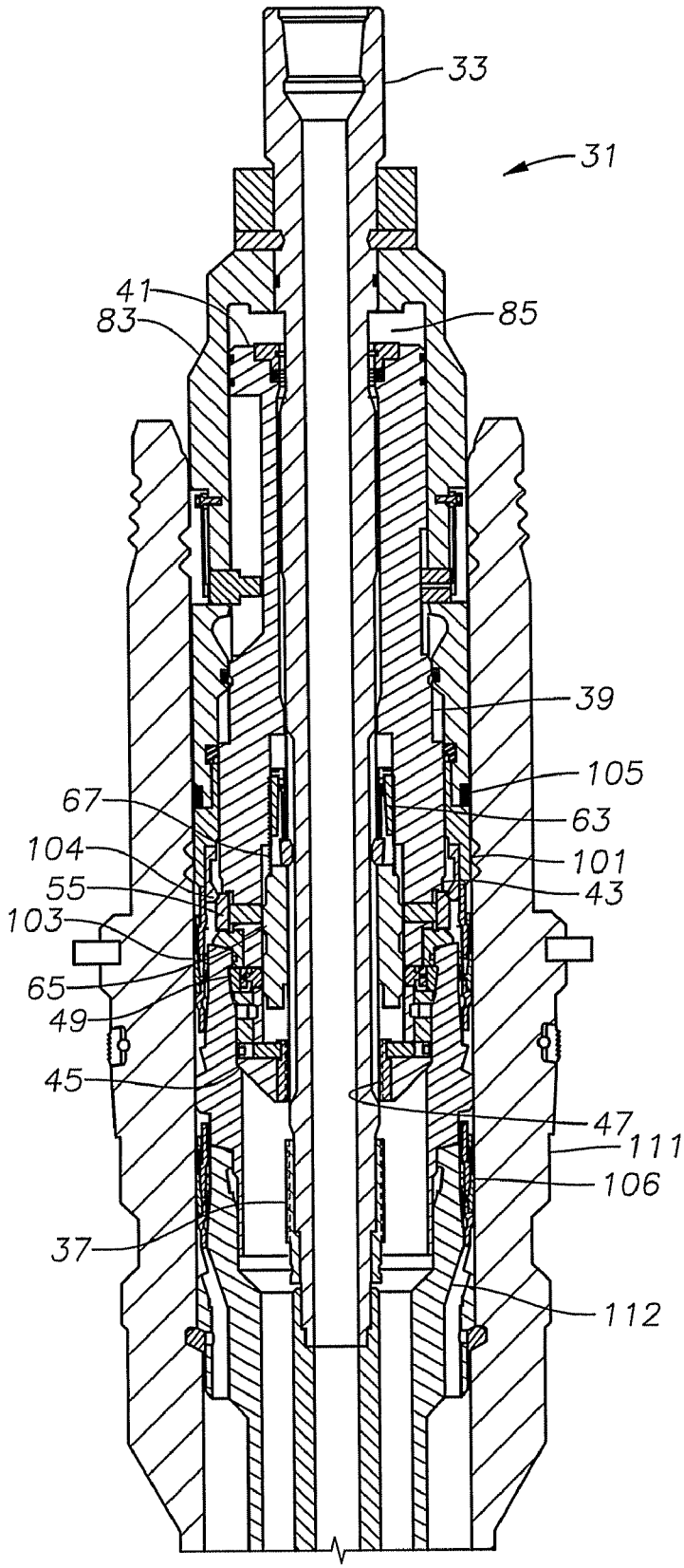
FIG. 4 is a sectional view of the running tool of FIG. 1 in the bridging hanger set position with the piston engagement element engaged with the piston.

Referring to FIG. 4, weight is then applied downward on the string of drill pipe (not shown) and subsequently to the stem 33 and the piston 83. As the stem 33 and the piston 83 move further longitudinally downward relative to the inner body 39, the latch ring 104 of the setting sleeve 101 and the packoff seal 103 abuttingly contacts the piston engagement element 55, preventing further movement downward of the setting sleeve 101 relative to the inner body 39, and thus, premature setting of the packoff seal 103. As the weight is applied downward on the elastomeric seal 105, the seal 105 expands radially outward, sealing between the running tool 31 and the high pressure housing 111.

Drillpipe rams (not shown) or an annular blower preventer (not shown) are closed and fluid pressure is applied down the annulus. The elastomeric seal 105 seals between the running tool 31 and the high pressure housing 111, allowing the pressure above the seal 105 to build until it forces the stem 33, piston 83, inner body 39, and bridging hanger 53 downward relative to the casing hanger 112. The engagement of the latch ring 104 with the piston engagement element 55 prevents the movement of the stem 33 and the piston 83 relative to the inner body 39. As the stem 33, piston 83, inner body 39, and bridging hanger 53 move simultaneously downward, the movement sets and seals the bridging hanger 53 to the casing hanger 112. The seal between the bridging hanger 53 and the casing hanger 112 is tested by applying fluid pressure down the drill pipe.

Figure 5:
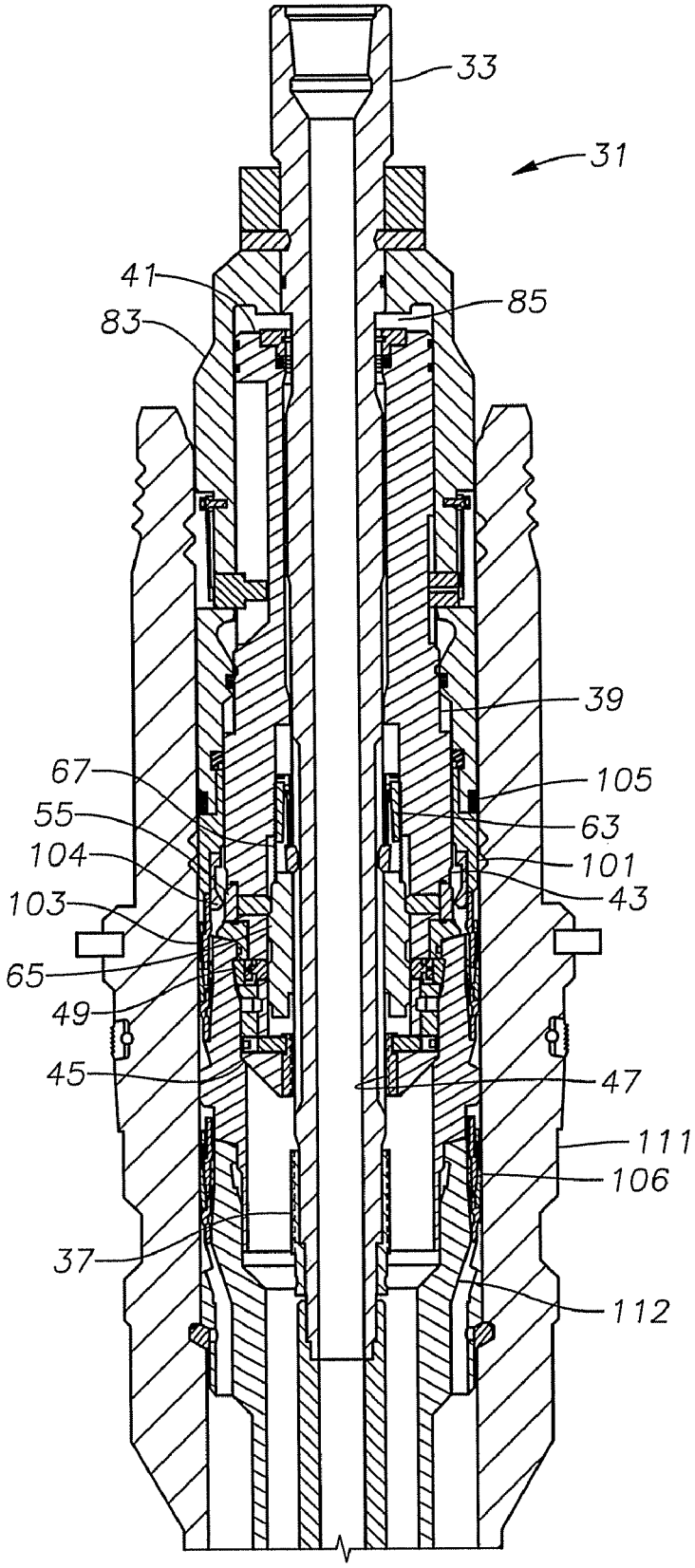
FIG. 5 is a sectional view of the running tool of FIG. 1 in the packoff landing position with the piston engagement element retracted.

Referring to FIG. 5, the stem 33 is then rotated four additional revolutions in the same direction. As the stem 33 is rotated relative to the inner body 39, the cam 65 moves longitudinally downward relative to the inner body 39. As the cam 65 moves longitudinally downward relative to the inner body 39, the piston engagement element 55 is no longer forced outward by the cam 65, and moves radially inward, thereby allowing the piston 83, setting sleeve 101, and packoff seal 103 to move further downward relative to the inner body 39. Weight is then applied downward on the string of drill pipe (not shown) and subsequently to the stem 33 and the piston 83. As the stem 33 and the piston 83 move further longitudinally downward relative to the inner body 39, the packoff seal 103 lands between the bridging hanger 53 and the high pressure housing 111. As the weight is applied downward on the elastomeric seal 105, the seal 105 expands radially outward, sealing between the running tool 31 and the high pressure housing 111.

Figure 6:
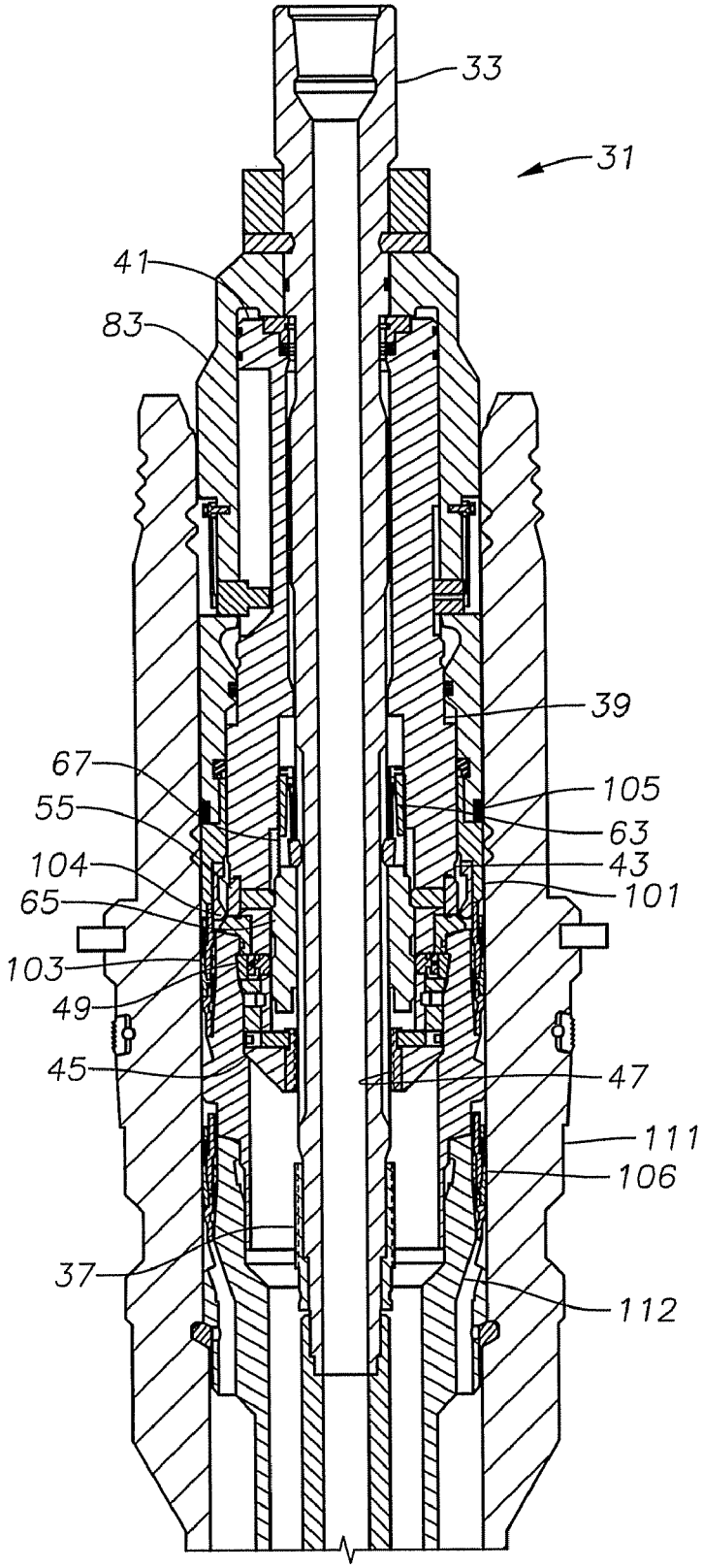
FIG. 6 is a sectional view of the running tool of FIG. 1 in the packoff set position.

Referring to FIG. 6, drillpipe rams (not shown) or an annular blowout preventer (not shown) are closed and fluid pressure is applied down the annulus. The elastomeric seal 105 seals between the running tool 31 and the high pressure housing 111, allowing the pressure above the seal 105 to build until it forces the stem 33 and the piston 83 longitudinally downward relative to the inner body 39. As the piston 83 moves downward, the movement of the piston 83 sets the packoff seal 103 between an outer portion of the bridging hanger 53 and the inner diameter of the subsea wellhead housing 111. The piston 83 moves longitudinally downward relative to the inner body 39 until piston chamber 85 (FIG. 1) is eliminated and the piston 83 and the inner body 39 are in contact with one another.

Once the piston 83 is driven downward and the packoff seal 103 is set, the drill string (not shown) and subsequently the stem 33 and piston 83 are pulled longitudinally upward relative to the inner body 39 with sufficient force to release the packoff seal 103 from the setting sleeve 101. As the stem 33 and the piston 83 move longitudinally upward relative to the inner body 39, the weight is removed from the elastomeric seal 105 and it moves radially inward, disengaging the inner surface of the wellhead housing 111, thereby permitting fluid flow past the seal 105. Fluid pressure is applied down the annulus to the upper side of packoff seal 103, thereby testing it.

Figure 7:
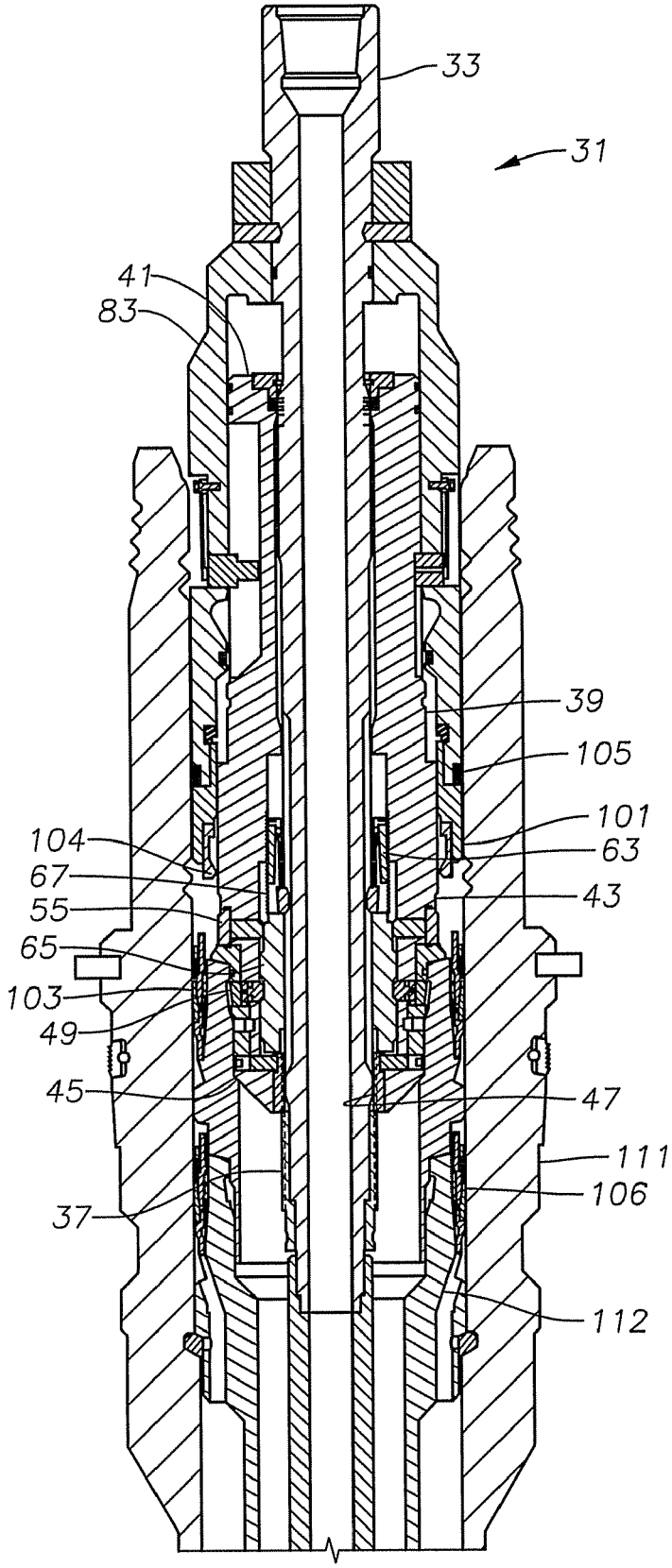
FIG. 7 is a sectional view of the running tool of FIG. 1 in the unlocked position with the hanger engagement element disengaged.

Referring to FIG. 7, once the packoff seal 103 has been tested, the stem 33 is then rotated four additional revolutions in the same direction. As the stem 33 is rotated relative to the inner body 39, the cam 65 moves longitudinally downward relative to the inner body 39. As the cam 65 moves longitudinally downward relative to the inner body 39, the hanger engagement element 49 is no longer forced outward by the cam 65, and moves radially inward, thereby unlocking the running tool 31 from the bridging hanger 53. The running tool 31 may then be removed from the wellbore and returned to the surface.

The technique has significant advantages. The running tool includes a piston engagement element that allows a bridging hanger and a packoff seal to be set and tested in the same trip. The piston engagement element prevents the premature setting of the packoff seal as the bridging hanger is set and tested, and is then disengaged to permit the packoff seal to be subsequently set and tested.

While the technique has been shown in only one of its forms, it should be apparent to those skilled in the art that it is not so limited but is susceptible to various changes without departing from the scope of the technique.

The invention claimed is:

1. A running tool for setting and sealing a well pipe hanger in a wellhead member, the running tool comprising:

an elongated stem having an axial passage;

an inner body substantially surrounding and connected to the stem such that rotation of the stem causes the stem to translate axially relative to the inner body;

a piston connected to the stem such that the piston and the stem rotate and translate in unison, the piston substantially surrounding portions of the stem and the inner body, the piston having a setting sleeve;

a packoff mounted to the setting sleeve of the piston;

a piston engagement element carried by the inner body and adapted to be engaged the setting sleeve to limit downward movement of the packoff at an intermediate location of the packoff and stem and to prevent axial movement of the stem and the piston relative to the inner body when setting and testing the well pipe hanger; and a seal carried by the running tool that engages an inner diameter surface of the wellhead member enabling hydraulic fluid pressure to be applied to the piston so as to set the well pipe hanger and move the piston and the packoff from the intermediate position to a set position.

2. The running to tool of claim 1, wherein the running tool further comprises:

threads on an inner portion of the inner body;

a cam positioned between the stem and the inner body, the cam connected to the stem such that the two rotate in unison but translate independent from one another, the cam having threads on its outer surface and first and second downward facing shoulders positioned adjacent thereto, the cam being threaded to the inner body;

a hanger engagement element, carried by the inner body and adapted to be engaged with the hanger, the axial movement of the stem relative to the inner body causing the first shoulder to contact the hanger engagement element and move it radially outward and in engagement with the hanger to releasably secure the running tool to the hanger; and the axial movement of the stem relative to the inner body simultaneously causing the second shoulder to contact the piston engagement element and move it radially outward for engagement with the piston to thereby prevent premature setting of the packoff.

3. The running to tool of claim 1, wherein the running tool further comprises:

a latch ring connected to the piston and adapted to be engaged with the piston engagement element when the running tool sets and tests the well pipe hanger, thereby preventing axial movement of the stem and the piston relative to the inner body, and thus, premature setting of the hanger packoff.

4. A running tool for setting a well pipe hanger and an annular seal in a subsea wellhead member, the running tool comprising:

a running tool member adapted to position the well pipe hanger and the annular seal within the subsea wellhead member;

a piston adapted to set the annular seal in the subsea wellhead member;

an engagement system adapted to prevent the piston from setting the annular seal until the well pipe hanger reaches a well pipe hanger set position by limiting movement of the piston in an intermediate position, thereby allowing the well pipe hanger and the annular seal to be set in a single trip, the intermediate position of the annular seal being a position between a running position and an annular seal set position; and a seal carried by the running tool that engages an inner diameter surface of a subsea wellhead enabling hydraulic fluid pressure to be applied to the piston so as to set the well pipe hanger and move the piston and the annular seal from the intermediate position to the annular seal set position.

5. The running tool according to claim 4, wherein the engagement system comprises:

threads on an inner portion of the running tool member;

a hanger engagement element, carried by the inner body and adapted to be engaged with the hanger; and a piston engagement element carried by the running tool member and configured to move radially outward for engagement with the piston to thereby prevent premature setting of the annular seal in response to axial movement of the stem relative to the running tool member.

6. The running tool according to claim 4, wherein the engagement system comprises a piston engagement element carried by the running tool member and adapted to move radially inward to allow the piston to set the annular seal.

7. A running tool for setting a well pipe hanger and a packoff of the well pipe hanger, the running tool comprising:

an elongated stem having an axial passage;

an inner body substantially surrounding and connected to the stem such that rotation of the stem causes the stem to translate axially relative to the inner body;

a piston connected to the stem such that the piston and the stem rotate and translate in unison, the piston substantially surrounding portions of the stem and the inner body;

a piston engagement element carried by the inner body and adapted to be engaged with the piston to prevent axial movement of the stem and the piston relative to the inner body when setting and testing the well pipe hanger;

threads on an inner portion of the inner body;

a cam positioned between the stem and the inner body, the cam connected to the stem such that the two rotate in unison but translate independent from one another, the cam having threads on its outer surface and first and second downward facing shoulders positioned adjacent thereto, the cam being threaded to the inner body;

a hanger engagement element, carried by the inner body and adapted to be engaged with the hanger, the axial movement of the stem relative to the inner body causing the first shoulder to contact the hanger engagement element and move it radially outward and in engagement with the hanger to releasably secure the running tool to the hanger; and the axial movement of the stem relative to the inner body simultaneously causing the second shoulder to contact the piston engagement element and move it radially outward for engagement with the piston to thereby prevent premature setting of the packoff.

8. A running tool for setting and sealing a bridging hanger in a casing hanger, the running tool comprising:

an elongated stem having an axial passage;

an inner body substantially surrounding and connected to the stem such that rotation of the stem causes the stem to translate axially relative to the inner body;

a piston connected to the stem such that the piston and the stem rotate and translate in unison, the piston substantially surrounding portions of the stem and the inner body, the piston having a setting sleeve;

a packoff mounted to the setting sleeve of the piston;

a ring having a smooth inner surface and a contoured outer surface and carried by the inner body and adapted to move radially outward in response to axial movement of a cam member and engage with the setting sleeve to limit downward movement of the packoff at an intermediate location of the packoff and stem; and a seal carried by the running tool that engages an inner diameter surface of the wellhead member enabling hydraulic fluid pressure to be applied to the piston so as to set the bridging hanger and move the piston and the packoff from the intermediate position to a set position.

* * * * *